US007084829B2

(12) United States Patent
Shirosaka et al.

(10) Patent No.: US 7,084,829 B2
(45) Date of Patent: Aug. 1, 2006

(54) SIGNAL RECEIVING SYSTEM

(75) Inventors: Toshiaki Shirosaka, Kobe (JP); Toshio Fujita, Kobe (JP); Kiyotaka Tatekawa, Kobe (JP); Shingo Fujisawa, Kobe (JP)

(73) Assignee: DX Antenna Company, Limited, Hyogo-Ken (JP)

( * ) Notice: Subject to any disclaimer, the term of this patent is extended or adjusted under 35 U.S.C. 154(b) by 115 days.

(21) Appl. No.: 10/796,611

(22) Filed: Mar. 9, 2004

(65) Prior Publication Data

US 2004/0196204 A1 Oct. 7, 2004

Related U.S. Application Data

(63) Continuation-in-part of application No. 10/756,216, filed on Jan. 13, 2004, now Pat. No. 6,933,907.

(30) Foreign Application Priority Data

Apr. 2, 2003 (JP) ..... 2003-99639

(51) Int. Cl.
*H01Q 1/50* (2006.01)

(52) U.S. Cl. ..... 343/850; 342/361

(58) Field of Classification Search ..... 343/850, 343/853, 895, 702, 794; 342/361
See application file for complete search history.

(56) References Cited

U.S. PATENT DOCUMENTS 4,737,793 A * 4/1988 Munson et al. ..... 342/361
4,926,187 A * 5/1990 Sugawara et al. ..... 342/361
6,384,767 B1 * 5/2002 Takase et al. ..... 342/51

FOREIGN PATENT DOCUMENTS

JP SHO 63-38574 10/1988

* cited by examiner

*Primary Examiner*—Trinh Dinh
*Assistant Examiner*—Huedung X. Cao
(74) *Attorney, Agent, or Firm*—Duane Morris LLP

(57) ABSTRACT

A signal receiving system includes a variable directivity antenna having its directivity varied in accordance with a control signal applied thereto. A control signal generator generating the control signal is provided in a receiving apparatus. The receiving apparatus includes also a modulator operating to ASK (amplitude-shift-keying) modulate a carrier with the control signal from the control signal generator into an ASK modulated signal. The ASK modulated signal is applied through a transmission line to the variable directivity antenna, and a controller associated with the variable directivity antenna demodulates the ASK modulated signal to recover the control signal for use in varying the directivity of the variable directivity antenna.

7 Claims, 15 Drawing Sheets

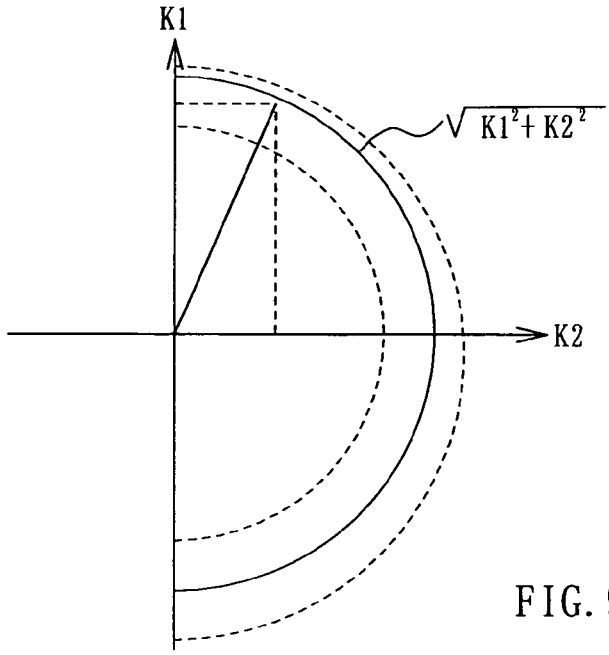
FIG. 9
FIG. 10A
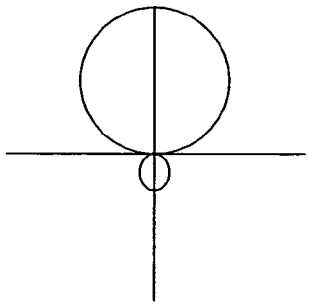
FIG. 10B
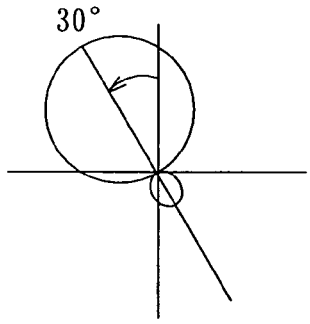
FIG. 10C
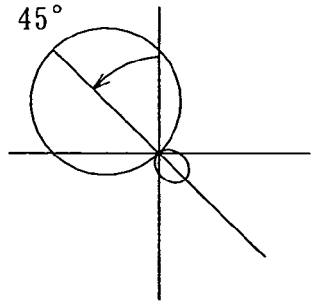
FIG. 10D
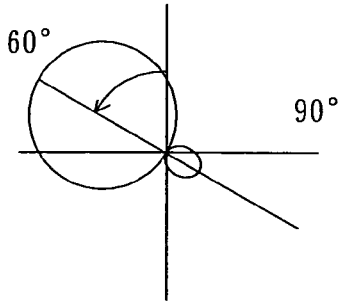
FIG. 10E
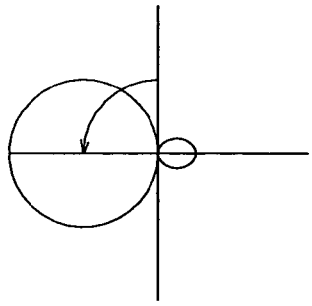
FIG. 10F
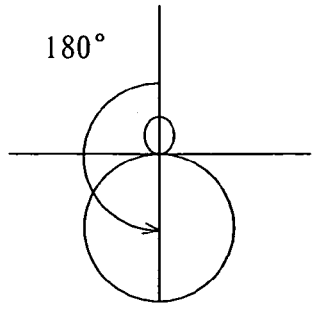

SIGNAL RECEIVING SYSTEM

This application is a continuation-in-part application of patent application Ser. No. 10/756,216 filed on Jan. 13, 2004 under the title "VARIABLE DIRECTIVITY ANTENNA AND VARIABLE DIRECTIVITY ANTENNA SYSTEM USING SUCH ANTENNAS", which issued on Aug. 23, 2005 as U.S. Pat. No. 6,933,907.

BACKGROUND OF THE INVENTION

A directional antenna may be used to receive a radio wave from a particular direction better than waves from other directions. A Yagi antenna is well-known as a directional antenna. A variable directivity antenna is used to selectively receive a desired one of radio waves from various directions. An example of variable directivity antenna is disclosed in Japanese Utility Model Publication No. SHO 63-38574 Y2 published on Oct. 12, 1988.

The variable directivity antenna disclosed in this Japanese UM publication includes first and second antennas which lie to orthogonally intersect with each other in the same horizontal plane. Dipole antennas or folded dipole antennas are used as the first and second antennas. A signal received by the first antenna is applied through a first variable attenuator to a combiner, and a signal received by the second antenna is applied through a second variable attenuator to the combiner. The directivity of the variable directivity antenna can be varied by adjusting the amounts of attenuation provided by the first and second variable attenuators.

The above-described variable directivity antenna has directivity that can rotate, and, therefore, it can receive only a radio wave from a desired direction selected from radio waves from various directions. However, the amounts of attenuation provided by the first and second variable attenuators of the variable directivity antenna disclosed in Japanese Utility Model Publication No. SHO 63-38574 Y2 are adjusted by varying the values of DC currents supplied to the first and second attenuators.

An object of the present invention is to provide a signal receiving system having its directivity varied with a modulated signal.

SUMMARY OF THE INVENTION

According to one embodiment of the present invention, a signal receiving system includes a variable directivity antenna having its directivity varied in accordance with a supplied control signal. A control signal generator is used to provide the control signal. A modulator modulates a carrier with the control signal generated by the control signal generator. A controller demodulates the modulated signal to recover the control signal from the modulated signal and supplies the recovered control signal to the variable directivity antenna. The modulator and the control signal generator may desirably be disposed at a location remote from the variable directivity antenna.

The modulator may be of a type that ASK (amplitude-shift-keying) modulates the carrier with the control signal.

The variable directivity antenna may be connected to a receiving apparatus through a transmission line. In this case, the modulator and the control signal generator are provided in the receiving apparatus. The transmission line transmits a signal received by the variable directivity antenna to the receiving apparatus and also transmits the modulated signal from the receiving apparatus to the variable directivity antenna.

Alternatively, the modulator may be external to the receiving apparatus. In such case, the transmission line transmits a signal received by the variable directivity antenna to the receiving apparatus and transmits the modulated signal from the modulator to the variable directivity antenna.

The variable directivity antenna may be supplied with a signal received by a separate antenna. In such case, the variable directivity antenna is provided with combining means for combining the signal from the separate antenna with a signal received by the variable directivity antenna. The output signal of the combining means is coupled to the receiving apparatus via the transmission line.

The variable directivity antenna may include two directional antennas having their directivities disposed orthogonal to each other, and two level adjusting means which are supplied with signals respectively received by the two directional antennas. In such case, the two level adjusting means are controlled with the control signal.

The variable directivity antenna may be coupled to a receiving apparatus through the transmission line. This receiving apparatus includes receiving condition detecting means for detecting the receiving condition in which a desired channel signal is being received. When the receiving condition becomes unacceptable, receiving apparatus control means operates to vary the control signal to be applied to the modulator from the control signal generator, and applies to the modulator the control signal available when the receiving condition as detected by the receiving condition detecting means becomes acceptable.

BRIEF DESCRIPTION OF THE DRAWINGS

FIG. 9 shows changes of two factors used in a variable attenuator in the antenna system of FIG. 8.

FIGS. 10A, 10B, 10C, 10D, 10E, and 10F show changes of the directivity of the antenna system of FIG. 8.

EMBODIMENTS

Figure 1:
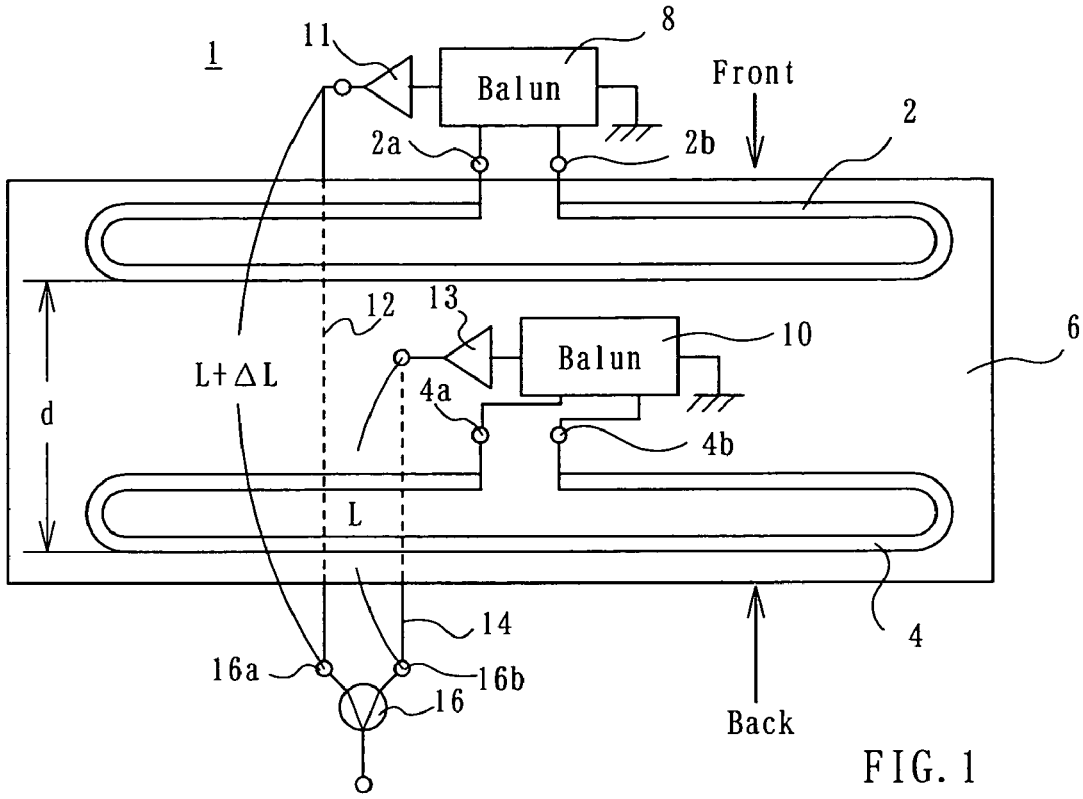
FIG. 1 is a plan view of a variable directivity antenna according to a first embodiment of the present invention.

A variable directivity antenna 1 according to a first embodiment of the present invention may be used to receive a radio wave in a first frequency band, e.g. in the UHF band (470–890 MHz) used for television broadcasting. As shown in FIG. 1, the antenna 1 has plural, e.g. two, antenna elements 2 and 4. The antenna elements 2 and 4 are folded dipole antennas of which the entire length is, for example, about 20 cm that is equal to about one-half of the wavelength λ at the center frequency, 620 MHz, of the UHF band. The two antenna elements 2 and 4 are disposed in parallel with each other with a predetermined distance d disposed therebetween. The distance d may be, for example, 20 mm, that is equal to about λ/20. The antenna elements 2 and 4 are planar type elements that are formed by etching a metal film on a printed circuit board 6.

Feeding points 2*a* and 2*b* disposed in the center portion of the antenna element 2 are coupled to a matching device, for example, a balun 8. Similarly, feeding points 4*a* and 4*b* in the center portion of the antenna element 4 are coupled to a balun 10. The baluns 8 and 10 may be formed on the printed circuit board 6, too, together with the antenna elements 2 and 4. The outputs of the baluns 8 and 10 are amplified in amplifiers 11 and 13, respectively. The amplifiers 11 and 13 may be formed on the printed circuit board 6, too. The outputs of the amplifiers 11 and 13 are coupled through feeders 12 and 14 to inputs 16*a* and 16*b*, respectively, of combining means, e.g. a combiner 16. Combining the signals from the antenna elements 2 and 4 after they are amplified by the amplifiers 11 and 13, provides a better C/N ratio than amplifying the combiner output. The lengths of the feeders 12 and 14 are different from each other. For example, the feeder 12 may have a length of L+ΔL, whereas the feeder 14 may have a length of L. In other words, the feeder 12 has a length larger by ΔL than the feeder 14.

The value ΔL is determined in the following way. Let it be assumed that the side of the antenna 1 on which the antenna element 2 is disposed is the front side, and the side of the antenna 1 on which the antenna element 4 is disposed is the back side. A radio wave coming from a second direction, i.e. coming from the back, in parallel with the surface of the printed circuit board 6 and perpendicularly to the length direction of the antenna elements 2 and 4, is received by the antenna elements 2 and 4 and propagates through the feeders 12 and 14 to the inputs 16*a* and 16*b* of the combiner 16, respectively. The signal resulting from the radio wave from the second direction as received by the antenna element 2 has its phase delayed from the signal resulting from the same radio wave as received by the antenna element 4, by an amount corresponding to the distance d between the antenna elements 2 and 4, and reaches the input 16*a* of the combiner 16, being delayed by an amount corresponding to ΔL, the difference in length between the feeders 12 and 14. In other words, the signal based on the radio wave from the second direction received by the antenna element 2 has its phase delayed from the signal based on the same radio wave received by the antenna element 4, by an amount corresponding to ΔL+d, when they reach the inputs 16*a* and 16*b* of the combiner 16, respectively. The value ΔL is determined such that the two signals at the inputs of the combiner 16 are opposite in phase.

A radio wave coming from a first direction, i.e. coming from the front, in parallel with the surface of the printed circuit board 6 and perpendicularly to the length direction of the antenna elements 2 and 4, is received by the antenna elements 2 and 4 and propagates through the feeders 12 and 14 to the inputs 16*a* and 16*b* of the combiner 16, respectively. The signal resulting from the radio wave from the first direction as received by the antenna element 4 has its phase delayed from the signal resulting from the same radio wave from the first direction as received by the antenna element 2, by the amount corresponding to the distance d between the antenna elements 2 and 4. The delay is reduced by ΔL.

For example, ΔL is determined such as to provide a delay corresponding to about 0.37λ. Then, although the radio wave from the first direction or front received by the antenna element 4 has a phase difference of +λ/20(=0.05λ) relative to the same radio wave from the front received by the antenna element 2, the signals from the antennas 2 and 4 resulting from that radio wave are combined with a phase difference equal to 0.32λ(=0.37λ−0.05λ) because they propagate through the feeders 12 and 14 before reaching the inputs 16*a* and 16*b* of the combiner 16. Also, the radio wave from the second direction or back received by the antenna element 4 has a phase difference of −0.05λ relative to the same radio wave from the back received by the antenna element 2. The signal from the antenna element 2 is provided with a delay of −0.37λ when it is transmitted through the feeder 12, and exhibits a phase difference of −0.42λ(=−0.05λ−0.37λ) relative to the signal from the antenna element 4 at the input 16*a* of the combiner 16. This phase difference is approximately λ/2, and, therefore, the signal from the back of the antenna 1 is substantially cancelled.

Then, the signals resulting from the radio wave from the front of the antenna 1 received by the antenna elements 2 and 4 are combined with a reduced phase difference, whereas the signals resulting from the radio wave from the back received by the antenna elements 2 and 4 are combined, being substantially oppositely phased. As a result, the antenna 1 operates as a directional antenna with no backward main lobe. Generally, if the lengths of the feeders from the antenna elements 2 and 4 to the combiner 16 are equal, the distance d between the antenna elements 2 and 4 must be λ/4 in order to couple signals resulting from a radio wave from the front as received by the antenna elements 2 and 4, in phase with each other to the inputs 16*a* and 16*b* of the combiner 16, and to couple signals resulting from a radio wave from the back as received by the antenna elements 2 and 4, in opposite phase to the inputs 16*a* and 16*b* of the combiner 16. Such larger distance d of λ/4 makes the antenna larger. In contrast, according to the first embodiment of the present invention, the distance d between the antenna elements 2 and 4 can be smaller, e.g. λ/20, than λ/4 because the difference of ΔL is provided between the length of the feeder 12 and the length of the feeder 14, and, therefore, the size of the antenna 1 can be smaller.

Figure 3:
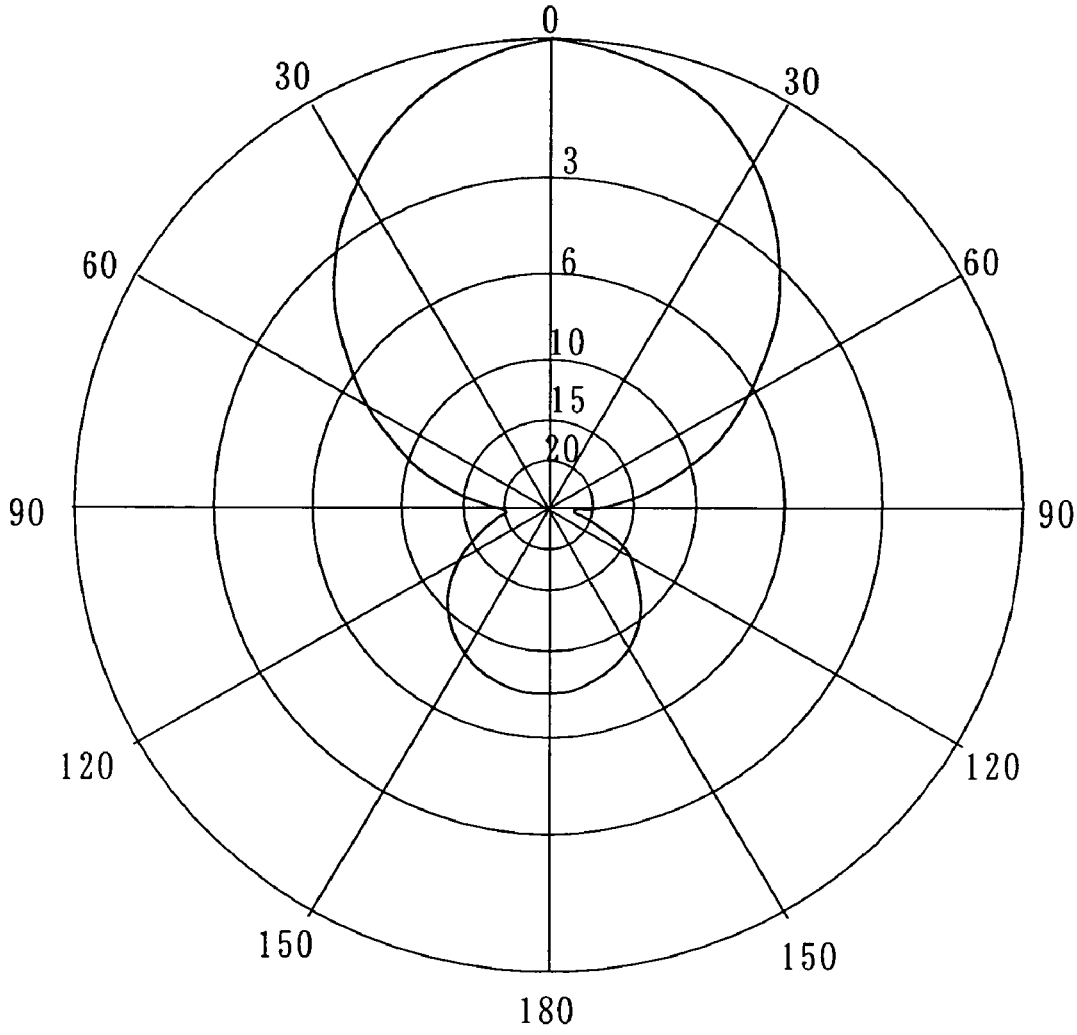
FIG. 3 shows a horizontal directivity pattern of the antenna of FIG. 1.
Figure 4:
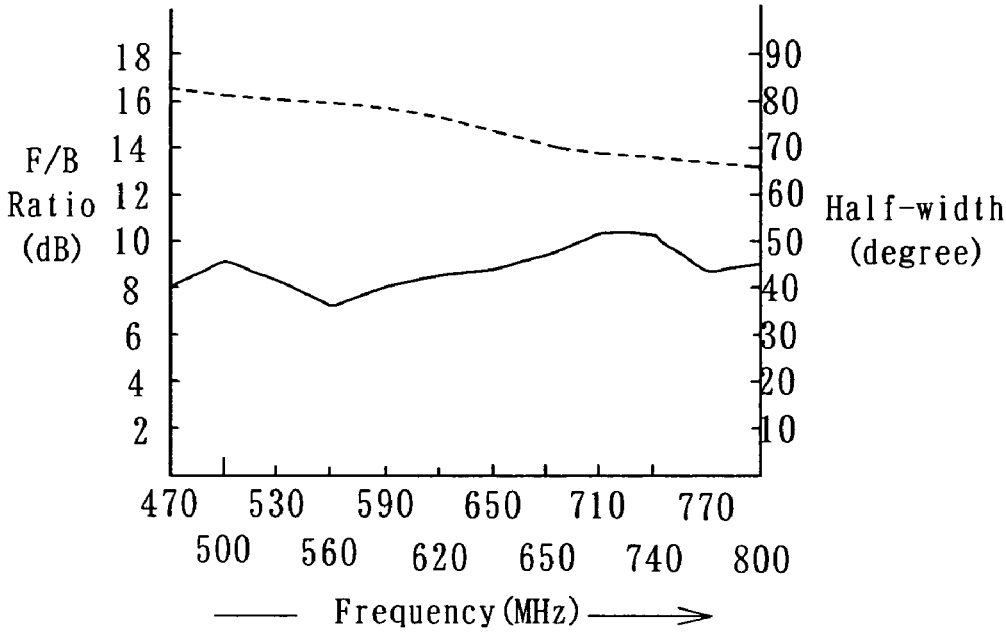
FIG. 4 shows F/B ratio versus frequency and half-width versus frequency characteristics of the antenna of FIG. 1.
Figure 5:
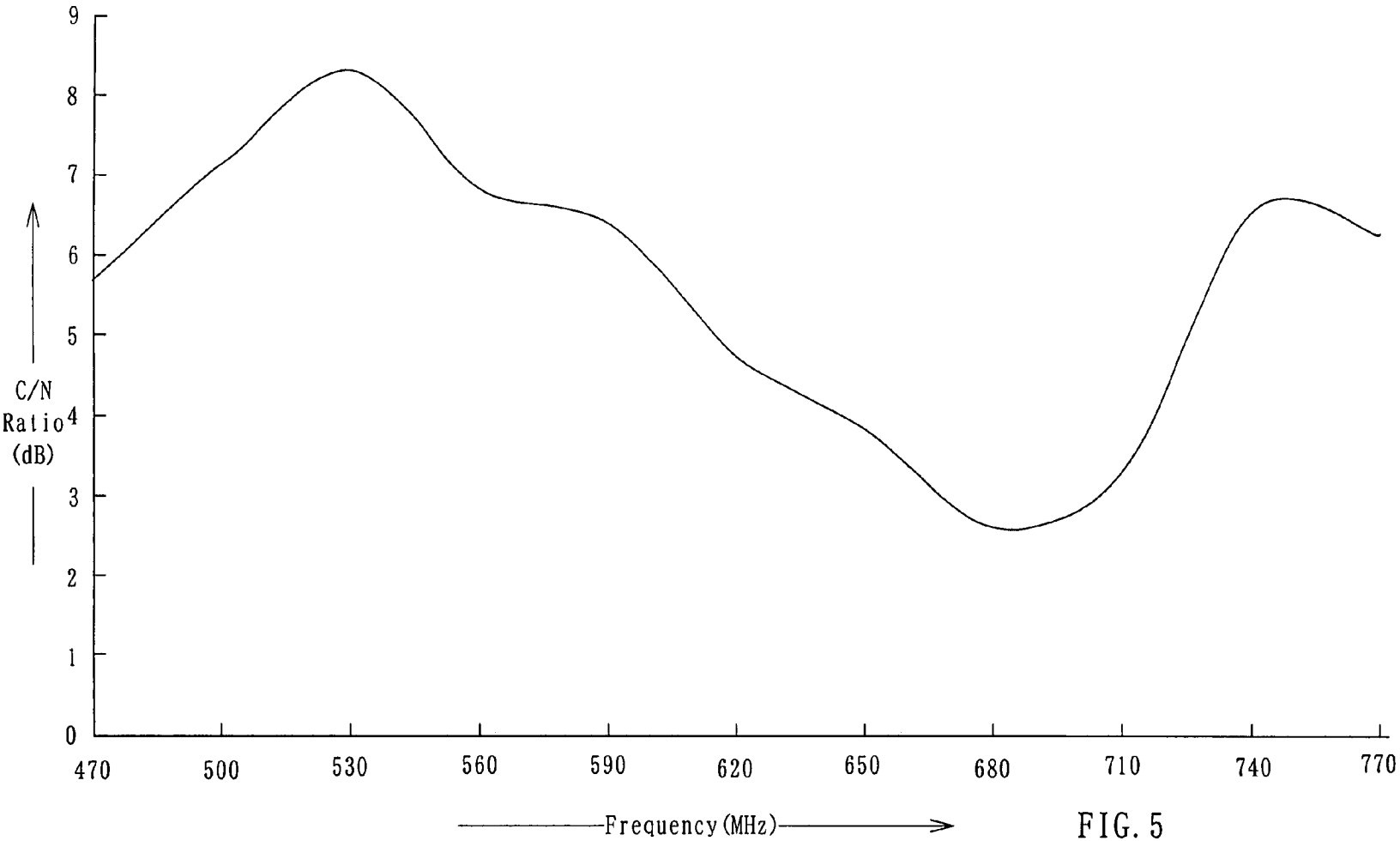
FIG. 5 shows a C/N ratio versus frequency characteristic of the antenna of FIG. 1.

FIG. 3 shows a horizontal directivity pattern of the antenna 1 at 470 MHz. As is understood from this pattern, the antenna 1 exhibits a large F/B ratio of, for example, 8.1 dB and, therefore, can receive radio waves from the front of the antenna 1 better than radio waves from the back. Also, the antenna 1 exhibits a half-width at about 82°. FIG. 4 shows the F/B ratio versus frequency characteristic of the antenna 1 and also the half-width versus frequency characteristic. The solid line is for the F/B ratio, and the broken line is for the half-width. As is seen, the F/B ratio is within a range of from about 7.5 dB to about 11 dB, which is sufficiently practically usable in the entire UHF band. Also, the half-width is within a range of from about 68° to about 82°, which is also practically useable in the entire UHF band. FIG. 5 shows the C/N ratio versus frequency characteristic of the antenna 1 relative to the antenna 1 with the amplifiers 11 and 13 removed. As is seen from FIG. 5, the use of the amplifiers 11 and 13 improves the C/N ratio by about 2.8 dB at the worst. The highest frequency of the UHF band shown in FIGS. 4 and 5 is about 800 MHz. In U.S.A., however, the highest frequency of the UHF band actually utilized is 806 MHz, and, therefore, FIGS. 4 and 5 clearly show that the antenna 1 is useful in receiving radio waves in the UHF band in U.S.A.

Figure 2:
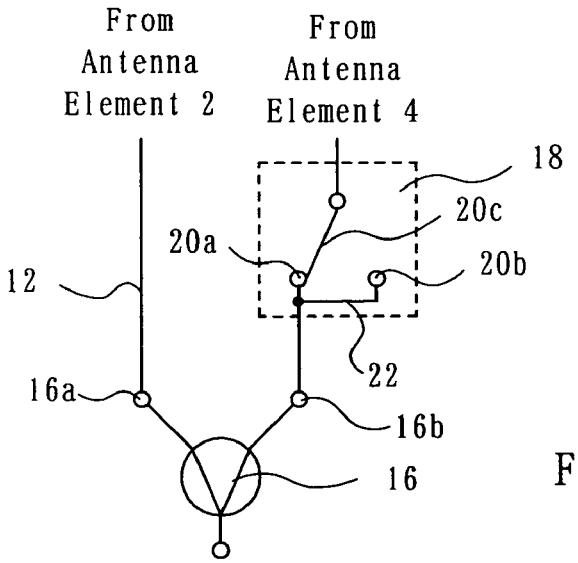
FIG. 2 is a circuit diagram of part of the antenna shown in FIG. 1.

The antenna 1 with the above-described arrangement is adapted to receive well only a radio wave coming from the front side of the antenna 1. However, it may become necessary for the antenna 1 to receive a radio wave coming thereto from the back. For that purpose, variable phase means, for example, a variable phase device 18 is connected to the input 16*b* of the combiner 16 as shown in FIG. 2. The variable phase device 18 can selectively assume a state in which it can couple the signal resulting from a radio wave received by the antenna element 4 and transmitted through the feeder 14 to the input 16*b* of the combiner 16 without modifying it, and a state in which it couples the signal to the input 16*b* after phase-shifting it by 180°. The 180° phase inverted version of the signal resulting from the radio wave from the front received by the antenna element 4 and transmitted through the feeder 14 can be combined with the signal of substantially opposite phase resulting from the same radio wave received by the antenna element 2 and transmitted through the feeder 12. The 180° phase inverted version of the signal resulting from the radio wave from the back of the antenna 1 received by the antenna element 4 and transmitted through the feeder 14 is combined with the signal resulting from the same radio wave from the back received by the antenna element 2 and transmitted through the feeder 12. Accordingly, the antenna 1 exhibits a backward directivity.

The variable phase device 18 has selecting means, for example, a selector switch 20 that has contacts 20*a* and 20*b*. The switch 20 also has a contact element 20*c* that is selectively brought into contact with the contacts 20*a* and 20*b*. The contact element 20*c* is connected to the feeder 14, and the contact 20*a* is connected to the input 16*b* of the combiner 16. Connected between the contacts 20*a* and 20*b* is a delay element, e.g. a delay line 22 having such a length as to provide a delay of 180° for the signal at the above-stated center frequency. With the contact 20*a* contacted by the contact element 20*c*, the signal transmitted through the feeder 14 is coupled to the input 16*b* of the combiner 16 without being delayed. With the contact 20*b* contacted by the contact element 20*c*, the signal transmitted through the feeder 14 has its phase inverted by the delay line 22 before being coupled to the input 16*b* of the combiner 16. The selector switch 20 may be an electronic selector switch, e.g. a semiconductor switching device. The semiconductor switching device may be, for example, a PIN diode. With an electronic selector switch, directivity switching can be remote controlled. The variable phase device 18 may be connected to the feeder 12 instead of the feeder 14. Further, the variable phase device 18 may be formed on the printed circuit board 6.

As described above, the antenna 1 exhibits directivity in selected one of the forward and backward directions, and can be small in size because it is formed on the printed circuit board 6.

Figure 6:
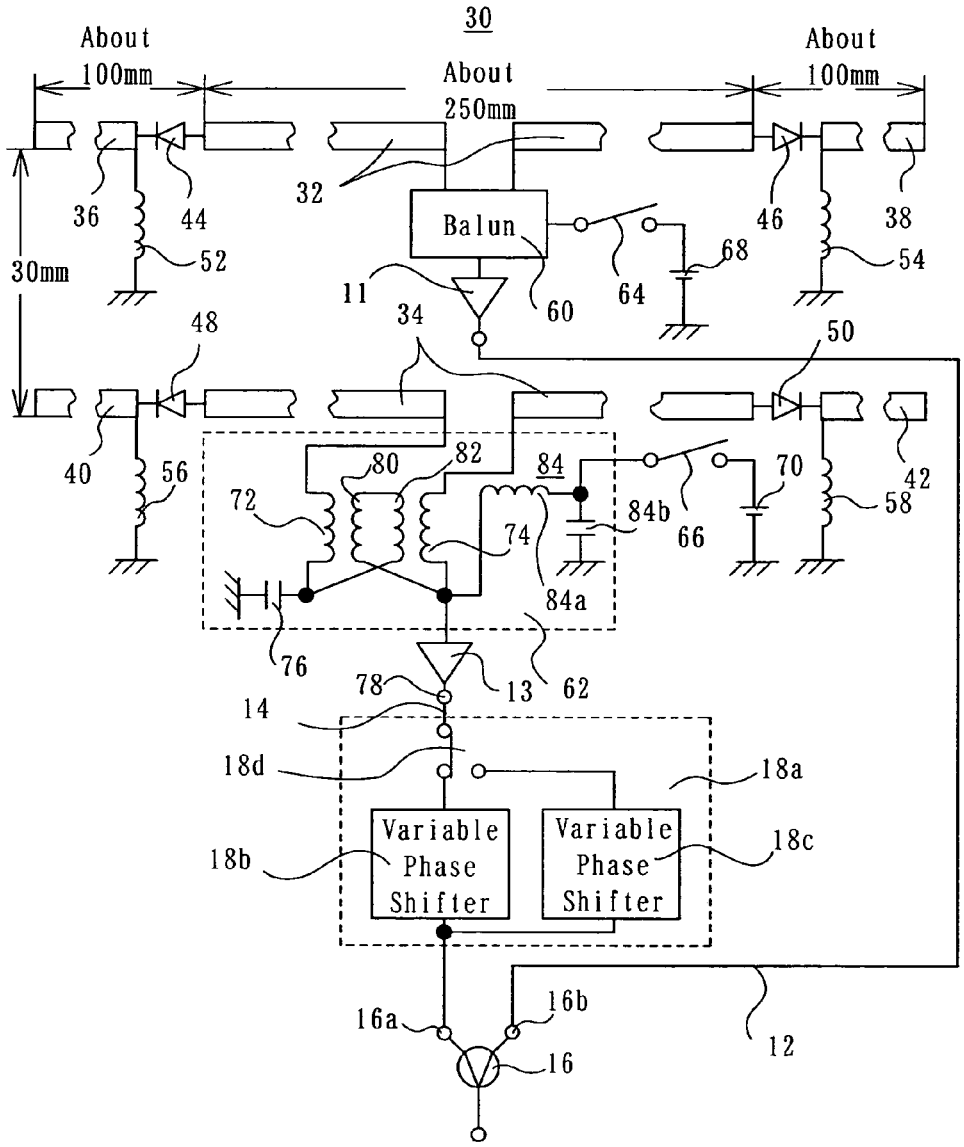
FIG. 6 schematically shows the arrangement of a variable directivity antenna according to a second embodiment of the present invention.
Figure 7:
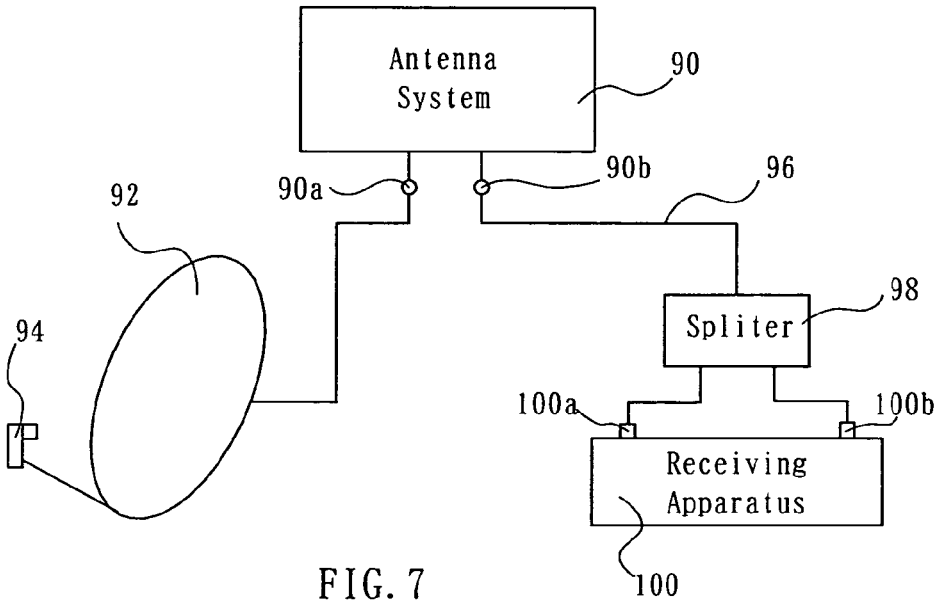
FIG. 7 is a block circuit diagram of a signal receiving system employing a variable directivity antenna system according to a third embodiment of the present invention.

The above-described antenna 1 is for receiving radio waves in the UHF band. An antenna 30 according to a second embodiment of the invention shown in FIG. 6 is arranged to be able to receive radio waves in a second frequency band, e.g. VHF television broadcasting waves (at frequencies of 54–88 MHz and 174–216 MHz), in addition to waves in the UHF band. In order for the antenna 30 to be operable both in the UHF and VHF bands, dipole antennas are used as antenna elements 32 and 34. The antenna elements 32 and 34 have a length of about 250 mm, and are disposed in parallel with each other. The antenna elements 32 and 34 are spaced by a distance d of about 30 mm. Like the antenna 1 of the first embodiment, the antenna elements 32 and 34 are formed on a printed circuit board.

Outward of and close to the respective opposite outer ends of the antenna element 32, extension elements 36 and 38 are disposed in line with the antenna element 32. Similarly, extension elements 40 and 42 are disposed in line with the antenna element 34 outward of and close to the respective opposite outer ends of the antenna element 34. The extension elements 36, 38, 40 and 42 are also formed on the printed circuit board by etching metal layers on the board. The length of each of the extension elements 36, 38, 40 and 42 is about 100 mm. Accordingly, the sum in length of the antenna element 32 and its extension elements 36 and 38 is about 450 mm, and the sum in length of the antenna element 34 and its extension elements 40 and 42 is also about 450 mm.

Switching means, which may be semiconductor switching devices, e.g. PIN diodes 44 and 46, are connected between the outer ends of the antenna element 32 and the extension elements 36 and 38, respectively. The PIN diodes 44 and 46 have their anodes connected to the antenna element 32 and have their cathodes connected respectively to the extension elements 36 and 38. Similarly, PIN diodes 48 and 50 are connected between the outer ends of the antenna element 34 and the extension elements 40 and 42, respectively. The PIN diodes 44 and 46 have their anodes connected to the antenna element 34 and have their cathodes connected respectively to the extension elements 40 and 42. With the PIN diodes 44, 46, 48 and 50 being conductive, the antenna element 32 is connected to the extension elements 36 and 38, and the antenna element 34 is connected to the extension elements 40 and 42, so that the antenna elements 32 and 34 with their extension elements can operate as VHF antennas. With the PIN diodes 44, 46, 48 and 50 rendered nonconductive, only the antenna elements 32 and 34 operate and act as UHF antennas.

In order to render the PIN diodes 44, 46, 48 and 50 conductive and nonconductive, the extension elements 36, 38, 40 and 42 are connected to a point of reference potential, e.g. a point of ground potential, via respective current supply paths, e.g. high-frequency blocking coils 52, 54, 56 and 58. In order to cause DC current to flow from the antenna element 32 through the PIN diodes 44 and 46 and the high-frequency blocking coils 52 and 54, a switch 64 and a DC supply 68 are connected to a balun 60 to which central feed points of the antenna element 32 are connected. Similarly, in order to cause DC current to flow from the antenna element 34 through the PIN diodes 48 and 50 and the high-frequency blocking coils 56 and 58, a switch 66 and a DC supply 70 are connected to a balun 62 to which central feed points of the antenna element 34 are connected. Instead of using the DC supplies 68 and 70 in association with the switches 64 and 66, respectively, a single DC supply may be connected to the switches 64 and 66.

The baluns 60 and 62 have the same configuration, and, therefore, only the balun 62 is described in detail. Respective one ends of inductors 72 and 74 are connected to the two feeding points of the antenna element 34. The other end of the inductor 72 is grounded via a capacitor 76, and the other end of the inductor 74 is connected to an output terminal 78 of the balun 62. An inductor 80 is disposed with respect to the inductor 72 in such a way that they are inductively coupled with each other, and an inductor 82 is disposed with respect to the inductor 74 in such a way that they are inductively coupled with each other. The inductors 80 and 82 have their one ends interconnected, with the other end of the inductor 80 connected to the other end of the inductor 74, and with the other end of the inductor 82 connected to the other end of the inductor 72. A series combination of the switch 66 and the DC supply 70 is connected via a low-pass filter 84 to the junction of the inductors 74 and 80. The low-pass filter 84 includes a high-frequency blocking coil 84*a* and a capacitor 84*b*.

With the switch 66 closed, current from the DC supply 70 flows through the inductor 74, the antenna element 34 and the PIN diode 50 to the high-frequency blocking coil 58, and also flows through the inductors 80, 82 and 72, the antenna element 34, and the PIN diode 48 to the high-frequency blocking diode 56. This renders the PIN diodes 48 and 50 conductive for receiving the UHF band. If the switch 66 is opened, no DC current flows from the DC supply 70, rendering the PIN diodes 48 and 50 nonconductive, for receiving the UHF band.

Similarly, by opening or closing the switch 64 associated with the balun 60, the UHF or VHF band reception mode can be selected. It is desirable to operate the switches 64 and 66 in synchronization with each other. By using semiconductor switching devices as the switches 64 and 66, and supplying external switching control signals to the switches 64 and 66, remote control is possible.

The remainder of the antenna 30 is similar to the antenna 1 of FIG. 1, the same reference numerals and symbols as used in FIG. 1 are used for the same or similar components, and their detailed description is not made. It should be noted, however, that a variable phase device 18*a* is used in place of the variable phase device 18. The variable phase device 18*a* includes two variable devices 18*b* and 18*c* for the reception of the VHF and UHF bands which are selectively used, being selected by a switch 18*d*. When the switches 64 and 66 are open, the variable phase device 18*b* for the UHF band is used, while the variable phase device 18*c* for the VHF band is used when the switches 64 and 66 are closed. By using a semiconductor switching device as the switch 18*d*, remote control of the variable phase device 18*a* is possible.

The above-described arrangement makes it possible to selectively receive radio waves in the UHF and VHF bands coming to the antenna 30 from the front and back thereof.

A signal receiving system employing a variable directivity antenna system 90 according to a third embodiment of the invention is shown in FIGS. 7 through 10 and FIGS. 11A and 11B. The variable directivity antenna system 90 includes an antenna set formed of antennas 30*a* and 30*b* of the same configuration as the antenna 30 according to the second embodiment shown in FIG. 6. The antenna system 90 can receive well any desired one of UHF and VHF radio waves coming from various directions.

The antenna system 90 receives, at its input terminal 90*a*, a satellite broadcast intermediate-frequency signal resulting from a satellite broadcast signal received by a satellite broadcast receiving antenna, e.g. a satellite broadcast receiving parabolic antenna 92, and frequency-converting in a converter 94 provided in association with the parabolic antenna 92. The satellite broadcast intermediate-frequency signal is mixed with a UHF or VHF band television broadcast signal received by the antenna system 90, and the mixture signal is outputted from an output terminal 90*b* of the antenna system 90. The mixture signal at the output terminal 90*b* is coupled through a transmission line 96 to a splitter 98 where the mixture signal is split into the satellite broadcast intermediate-frequency signal and the VHF or UHF band television broadcast signal. The satellite broadcast intermediate-frequency signal is coupled to a satellite broadcast intermediate-frequency signal input terminal 100*a* of a receiving apparatus 100, and the VHF or UHF band television broadcast signal is coupled to a VHF/UHF band television broadcast signal input terminal 100*b*.

Figure 8:
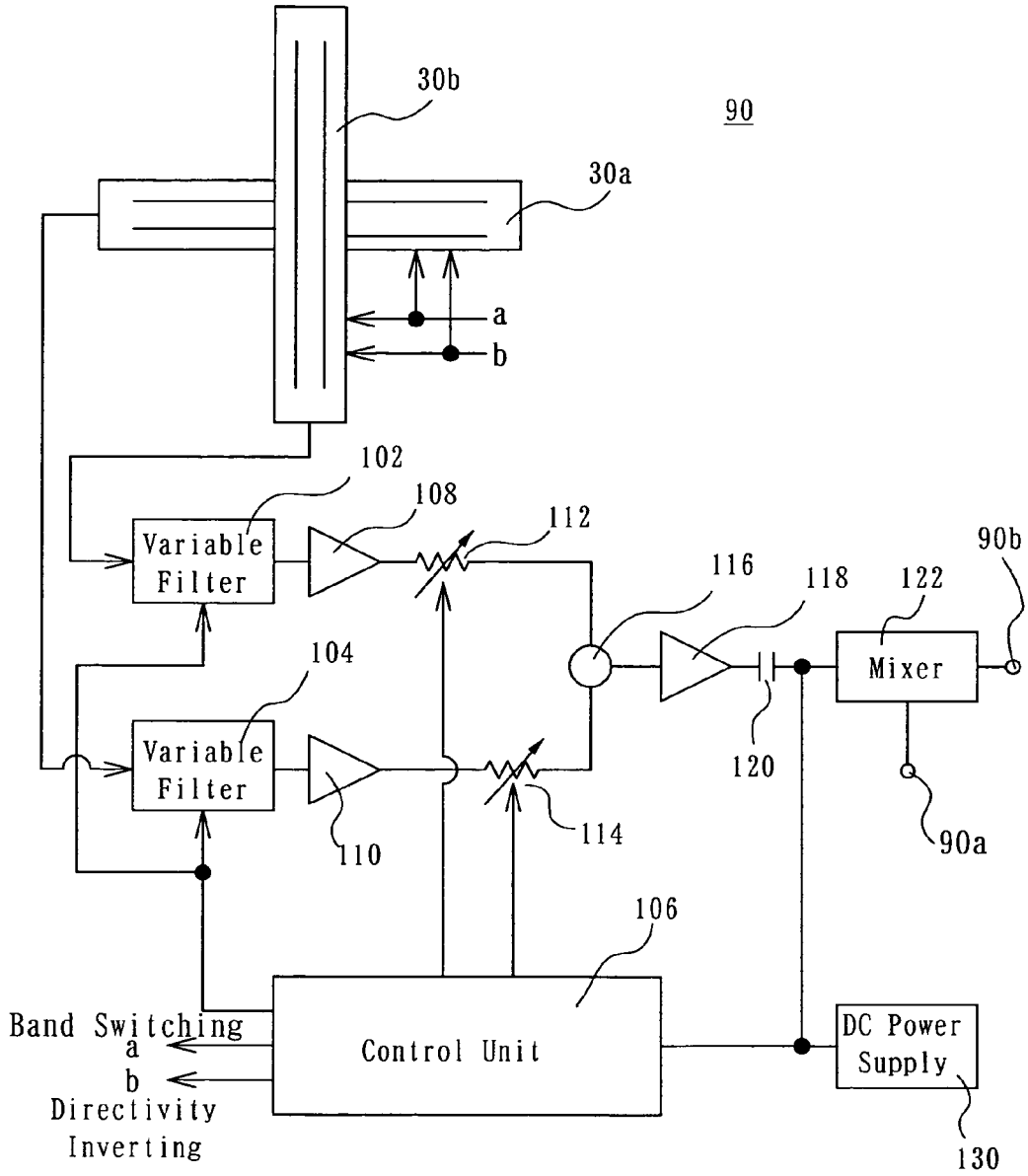
FIG. 8 is a block circuit diagram of the variable directivity antenna system of the third embodiment used in the signal receiving system of FIG. 7.

The antennas 30*a* and 30*b* of the antenna system 90 are disposed to orthogonally intersect with each other as shown in FIG. 8. The antenna elements 30*a* and 30*b* are formed on separate printed circuit boards by etching and are disposed at different levels so as to be orthogonal with each other at their feeding points. The antenna elements 30*a* and 30*b* may be formed on a single printed circuit board.

Signals from the antenna elements 30*a* and 30*b* are coupled to variable filter means, e.g. variable filters 102 and 104. The variable filters 102 and 104 are bandpass filters having variable passbands. The passband of each filter 102, 104 is varied in response to a passband varying signal supplied by passband varying control means, e.g. a control unit 106. The passbands are varied so that the frequencies of the radio waves to be received by the antenna system 90 can lie in the passbands. In place of the bandpass filters, variable cutoff frequency high-pass or low-pass filters may be used. The cutoff frequencies of such high-pass or low-pass filters are so varied that the frequencies of the waves to be received can be within the passbands of the filters.

Output signals of the variable filters 102 and 104 are amplified in amplifiers 108 and 110, respectively, and coupled to level adjusting means, e.g. variable attenuators 112 and 114, respectively. The variable attenuators 112 and 114 may include a semiconductor device, e.g. a PIN diode, having its conductivity varied in response to a respective level control signal supplied to it from level control signal generating means, which may be the control unit 106. Variable gain amplifiers may be used in place of the variable attenuators 112 and 114.

The output of the variable attenuator 112 is the output signal from the amplifier 108 multiplied by a factor K1, and the output of the variable attenuator 114 is the output signal from the amplifier 110 multiplied by a factor K2. The factor K1 is variable in response to the level control signal for the variable attenuator 112, and the factor K2 is variable in response to the level control signal for the variable attenuator 114. As shown in FIG. 9, the level control signal for the variable attenuator 112 varies the factor K1 from a first value, e.g. 1, through 0 to a second value, e.g. −1, which is equal in absolute value but has an opposite sign to the first value. The variation is in a cosine waveform fashion. The level control signal for the variable attenuator 114 varies the factor K2 from zero through the first value, e.g. 1, back to 0. The variation of the factor K2 is sinusoidal and in synchronization with the factor K1. Accordingly, the value of $K1^2+K2^2$ is always the first value, e.g. 1. The value of the sum, $K1^2+K2^2$, can be other than 1, as shown in FIG. 9, as long as the factors K1 and K2 change in the above-described synchronized, sine and cosine waveform fashions.

The control unit 106 provides the antennas 30*a* and 30*b* with frequency-band switching signals for switching the antenna 30*a* and 30*b* between the UHF receiving mode and the VHF receiving mode, i.e. selectively opening and closing the switches 64 and 66 shown in FIG. 6, and for switching the switch 18*d* of the variable phase device 18*a*. Also, the control unit 106 provides the antennas 30*a* and 30*b* with a directivity inverting signal for inverting the phase of signals by 180° in the variable phase devices 18*b* and 18*c*.

Output signals of the variable attenuators 112 and 114 are combined with each other in combining means, e.g. a combiner 116. Thus, the directivity of the combined signal of the antennas 30*a* and 30*b* as combined in the combiner 116 can be varied to any desired direction by changing the factors K1 and K2, as is well known. Let it be assumed that the phase shifters 18*b* and 18*c* are so adjusted to provide, for example, the antenna 30*a* with the upward directivity in the plane of the sheet of FIG. 8, and the antenna 30*b* with the leftward directivity. In this state, if the factor K1 for the variable attenuator 112 is 1 and the factor K2 for the variable attenuator 114 is 0, the directivity of the signal at the output of the combiner 116 is as shown in FIG. 10A. When the factor K1 is cos 30° with the factor K2 being sin 30°, the directivity rotates by 30° from the one shown in FIG. 10A to the one shown in FIG. 10B. With the factors K1 and K2 being cos 45° and sin 45°, respectively, the directivity rotates by 45° from the one shown in FIG. 10A to the one shown in FIG. 10C. With the factors K1 and K2 being cos 60° and sin 60°, respectively, the directivity rotates by 60° from the one shown in FIG. 10A to the one shown in FIG. 10D. With the factors K1 and K2 being cos 90° and sin 90°, respectively, the directivity rotates by 90° from the one shown in FIG. 10A to the one shown in FIG. 10E. Similarly, when the factor K1 is changed to cos 180° with the factor K2 changed to sin 180°, the directivity changes from the one shown in FIG. 10E to the one shown in FIG. 10F. By properly selecting the values of the factors K1 and K2, the directivity can be changed to any one lying between adjacent ones shown in FIGS. 10A–10F. To change the directivity from the one shown in FIG. 10F to any desired one between the directivities shown in FIGS. 10F and 10A, the variable phase devices 18*b* and 18*c* associated with the antennas 30*a* and 30*b* are adjusted to invert, by 180°, the directivities inherent to the antennas 30*a* and 30*b*, and, then, the factors K1 and K2 are changed in a manner similar to the one described above.

As described above, since the directivity of the antenna system 90 can be changed to any direction, it can receive well any desired one of radio waves from various directions. The control unit 106 controls the passbands of the variable filters 102 and 104 to pass therethrough the desired radio wave when it is being received by the antenna system 90, whereby the antenna system 90 is prevented from receiving undesired radio waves, which can improve a D/U ratio.

An output signal from the combiner 116 is amplified by an amplifier 118 and, then, coupled through a DC blocking capacitor 120 to a mixer 122. The mixer 122 receives also the satellite broadcast intermediate-frequency signal from the input terminal 90*a* of the antenna system 90. The output signal of the combiner 116 and the satellite broadcast intermediate-frequency signal are mixed with each other in the mixer 122, and the mixture signal developed at the output terminal 90*b* of the antenna system 90 is coupled via the transmission line 96 to the splitter 98 where the output signal of the mixer 116 and the satellite broadcast intermediate-frequency signal are separated for application to the satellite broadcast intermediate-frequency signal input terminal 100*a* of the receiving apparatus 100, and to the television broadcast signal input terminal 100*b*, as described previously.

A television broadcast signal processing unit of the receiving apparatus 100 includes, as shown in FIG. 11, a tuner 126 to which the television broadcast signal, i.e. the output signal of the mixer 116, is coupled through a DC blocking block 124, and the tuner 126 demodulates the received television broadcast signal. The receiver 100 includes a power supply unit, e.g. a DC power supply unit 128, for driving the antenna system 90. A DC voltage from the DC power supply unit 128 is coupled through the input terminal 100*b*, the splitter 98, the transmission line 96, the output terminal 90*b* of the antenna system 90, and the mixer 122 to a DC power supply unit 130 (FIG. 8). The DC power supply unit 130 regulates the voltage for application to various sections. The DC power supply unit 130 supplies DC power to the PIN diodes of the antenna 30*a* and 30*b*.

The receiving apparatus 100 includes also memory means, e.g. a memory 131. The memory 131 stores therein control signals, e.g. antenna control data necessary for the antenna system 90 to receive desired radio waves (e.g. a television broadcast channel desired to be received). Such control data is stored, being correlated with corresponding channel data indicative of respective desired television broadcast channels, and indicates the receiving band to be received, i.e. the UHF or VHF band, the desired direction of directivity, the passbands of the variable bandpass filters, and the phase conditions of the variable phase devices 18*b* and 18*c*. When the tuner 126 reads out channel data from the memory 131, the associated antenna control data is supplied to an antenna control commander 132. The tuner 126 and the memory 131 provide a control signal generator. The antenna control commander 132 converts the antenna control data to a PSK (phase-shift-keying) signal, an FSK (frequency-shift-keying) signal or an ASK (amplitude-shift-keying) signal.

Figure 11A:
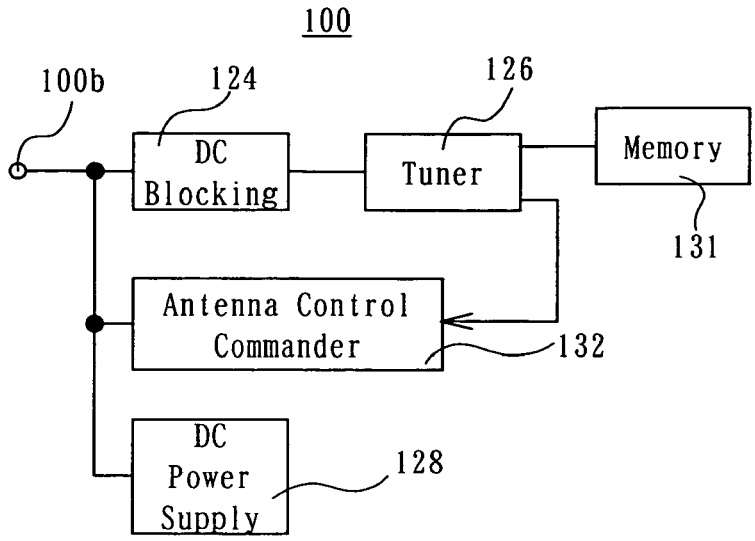
FIG. 11A is a block diagram of a receiving apparatus in the signal receiving system of FIG. 7.
Figure 11B:
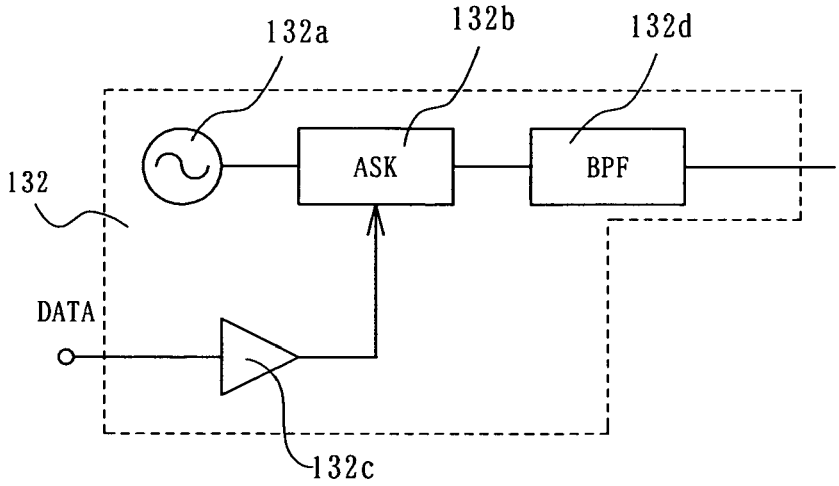
FIG. 11B is a block diagram of an antenna control commander used in the receiving apparatus shown in FIG. 11A.

For the ASK signal conversion, for example, the antenna control commander 132 may have an arrangement shown in FIG. 11B. The antenna control commander 132 is provided with a carrier signal generator 132*a*, which generates a carrier signal at a frequency of, for example, 10.7 MHz, that is different from the frequency of the received signal supplied from the antenna system 90. The carrier signal is applied to an ASK modulator 132*b*, to which the antenna control data is coupled through a buffer 132*c* from the memory 131. The carrier signal is ASK modulated in accordance with the antenna control data, and the resultant ASK signal is outputted from the modulator 132*b* through a bandpass filter 132*d* which removes undesired signal components. For producing a PSK or FSK signal, a modulator which PSK or FSK modulates the carrier signal with the antenna control data is used in place of the ASK modulator 132*b*.

The resulting PSK, FSK or ASK signal is applied to the control unit 106 through the input terminal 100*b*, the splitter 98, the transmission line 96, the output terminal 90*b* of the antenna system 90, and the mixer 122. When receiving the PSK, FSK or ASK signal, the control unit 106 demodulates the PSK, FSK or ASK signal to recover the antenna control data. In accordance with the demodulated or recovered antenna control data, the switches 66 and 68 of the antennas 30*a* and 30*b* are ON-OFF controlled, the passbands of the variable filters 102 and 104 are modified, and the factors K1 and K2 for the variable attenuators 112 and 114 are altered, and the variable phase devices 18*b* and 18*c* of the antennas 30*a* and 30*b* are set to provide in-phase or 180°-out-of-phase condition.

Figure 12:
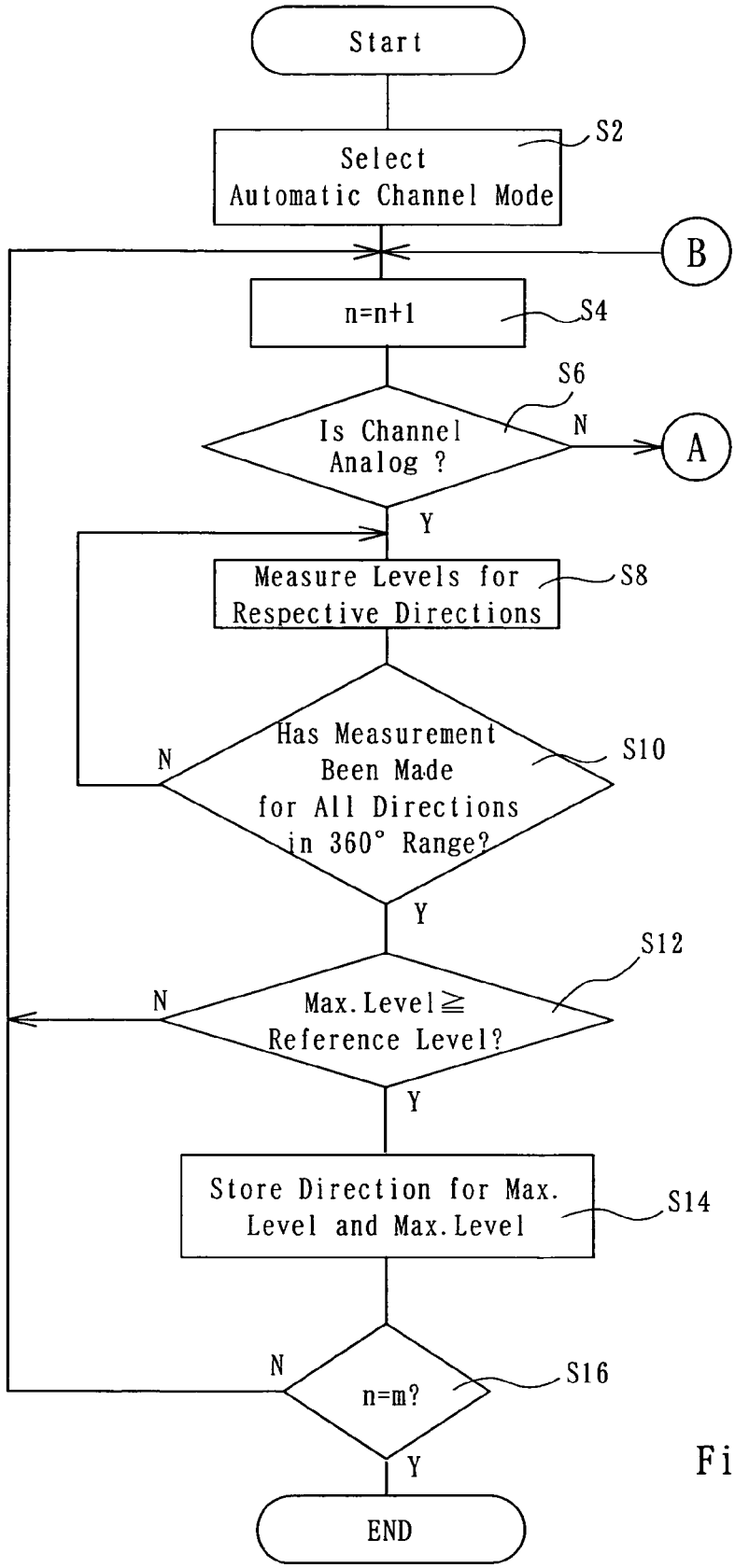
FIG. 12 shows part of a flow chart for use in explaining how antenna directivities are stored in a memory in a tuner of the receiving apparatus of FIG. 11A.
Figure 13:
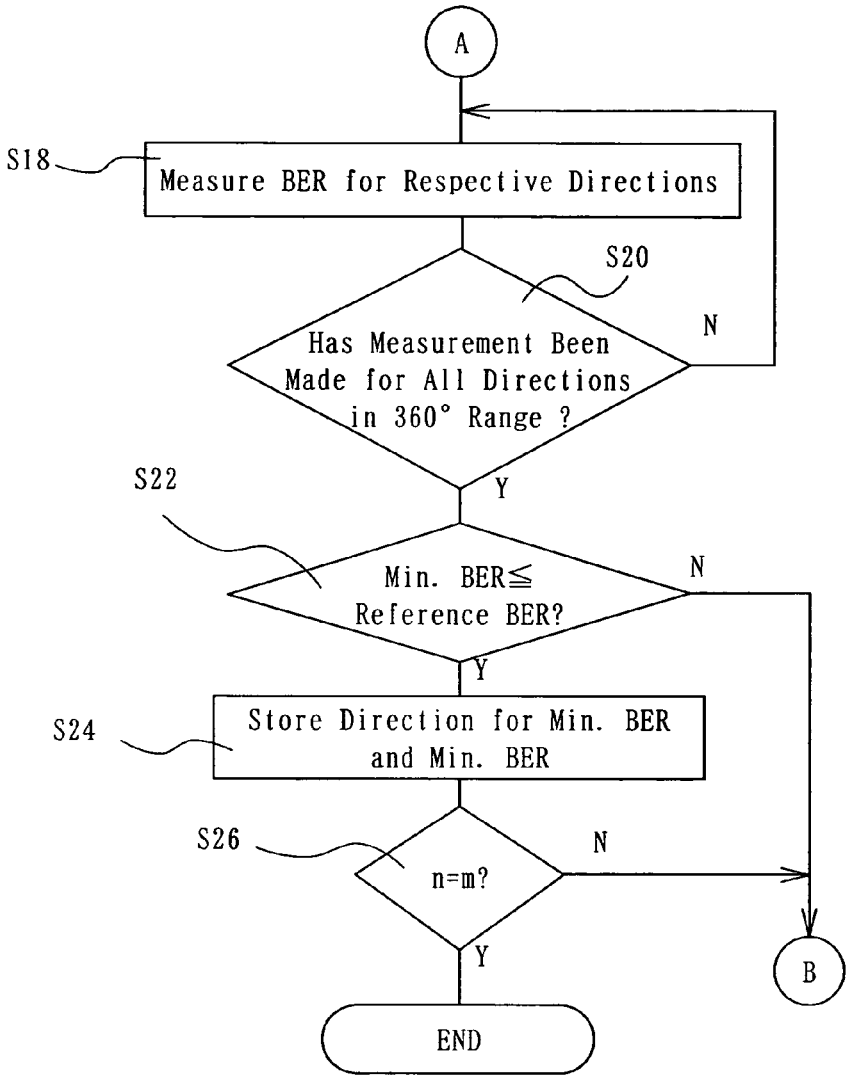
FIG. 13 shows the remainder of the flow chart for use in explaining how antenna directivities are stored in a memory in a tuner of the receiving apparatus of FIG. 11A.

In order for such control to be provided, it is necessary to store the receiving channel data and the corresponding antenna control data in association with each other, in the memory 131. For that purpose, the processing as shown in FIGS. 12 and 13 is performed in the tuner 126. The tuner 126 can receive both analog television broadcast signals and digital television broadcast signals.

First, an automatic channel mode is selected (Step S2). This causes the channel designating value in a channel counter n to be set to an initial value. The channel counter n is for designating a channel to be received. Then, the value in the channel counter n is increased by one for designating a certain channel to be received (Step S4), whereby this channel is selected in the tuner 126, and, at the same time, data for making the variable filters 102 and 104 have passbands for receiving that channel is transmitted from the antenna control commander 132 to the control unit 106. Then, the tuner 126 makes a judgment as to whether the selected channel is an analog television broadcast channel or not (Step S6).

If the selected channel is an analog television broadcast channel, a command is transmitted from the antenna control commander 132 to the control unit 106 to successively change K1 and K2 and also to adjust the variable phase devices 18*b* and 18*c* to provide the in-phase or 180°-out-of-phase condition, whereby the direction of directivity of the antenna is successively changed. The reception level for each direction is measured in the tuner 126 and stored (Step S8). In Step S10, whether the directivity of the antenna has been measured for all the predetermined directions in the angular range of 360° or not is judged. If it has not, the execution of Steps S8 and S10 is repeated in loop until the answer to the query in Step S10 becomes YES. When the answer to the query in Step S10 becomes YES, whether or not the largest one of the measured levels is at or above a predetermined reference level is examined (Step S12). In other words, whether or not there is directivity providing an acceptable receiving condition is judged. If the answer is YES, the direction of directivity providing the largest reception level is stored together with the largest reception level in the memory 131 (Step S14). At the same time, the data representing the passbands of the variable filters 102 and 104, and the data indicating which condition, in-phase or 180°-out-of-phase condition, the variable phase devices 18*b* and 18*c* provided, employed when the largest reception level has been attained, are stored in the memory 131 in association with the largest directivity providing direction and the largest reception level. After that, whether the value in the channel counter n is the value for the last one of the receiving channels is judged (Step S16). If the answer is NO, it means that there are channels left for which the direction of directivity has not yet been determined. Then, the processing is repeated from Step S4 until the answer to the query in Step S16 becomes YES.

The answer of NO to the query in Step S12 indicates that there is a possibility that no radio wave is broadcast in that channel. In this case, Step S4 is executed to designate the next receiving channel.

If the selected channel is judged to be a digital television broadcast channel in Step S6, as indicated by a circled A, the direction of directivity of the antenna system 90 is varied, and the bit error rate (BER) for each direction is measured and stored (Step S18), as shown in FIG. 13. Then, whether the bit error rate has been measured and stored for all of the predetermined directions in the angular range of 360° is judged (Step S20). If the measurement and storage has not been completed, Steps S18 and S20 are repeated in loop until the answer in Step S20 changes to YES. When the answer to the query in Step S20 changes to YES, whether the smallest one of the measured bit error rates is equal to or smaller than a predetermined rate is judged (Step S22). That the smallest bit error rate is not greater than the predetermined rate means that the digital television broadcast signal can be received by the antenna system 90 with an allowable level, that direction of the antenna directivity and the smallest bit error rate are stored in the memory 131 (Step S24). At the same time, the data specifying the passbands of the variable filters 102 and 104, and the data indicating which condition, in-phase or 180°-out-of-phase condition, the variable phase devices 18*b* and 18*c* provide, employed when the allowable smallest bit error rate has been attained, are stored in the memory 131 in association with the direction of the antenna directivity in which the smallest bit error rate is measured and that smallest bit error rate. Thereafter, whether the value in the channel counter n is the value corresponding to the largest channel is seen (Step S26), and if the value is not for the largest channel, the steps are repeated from Step S4, as indicated by a circled B.

The answer of NO to the query in Step S22 may mean that no wave is broadcast in that channel, and, therefore, the processing is repeated from Step S4.

In this way, the storing in the memory 131 of the antenna control data necessary for the antenna system 90 to receive desired radio waves is completed.

It may occur that, while a radio wave of a certain television channel is being received by the tuner 126, a broadcast signal condition worsens to an unacceptable condition. In such a case, processing as shown in FIGS. 14 and 15 is executed for that television channel.

Figure 14:
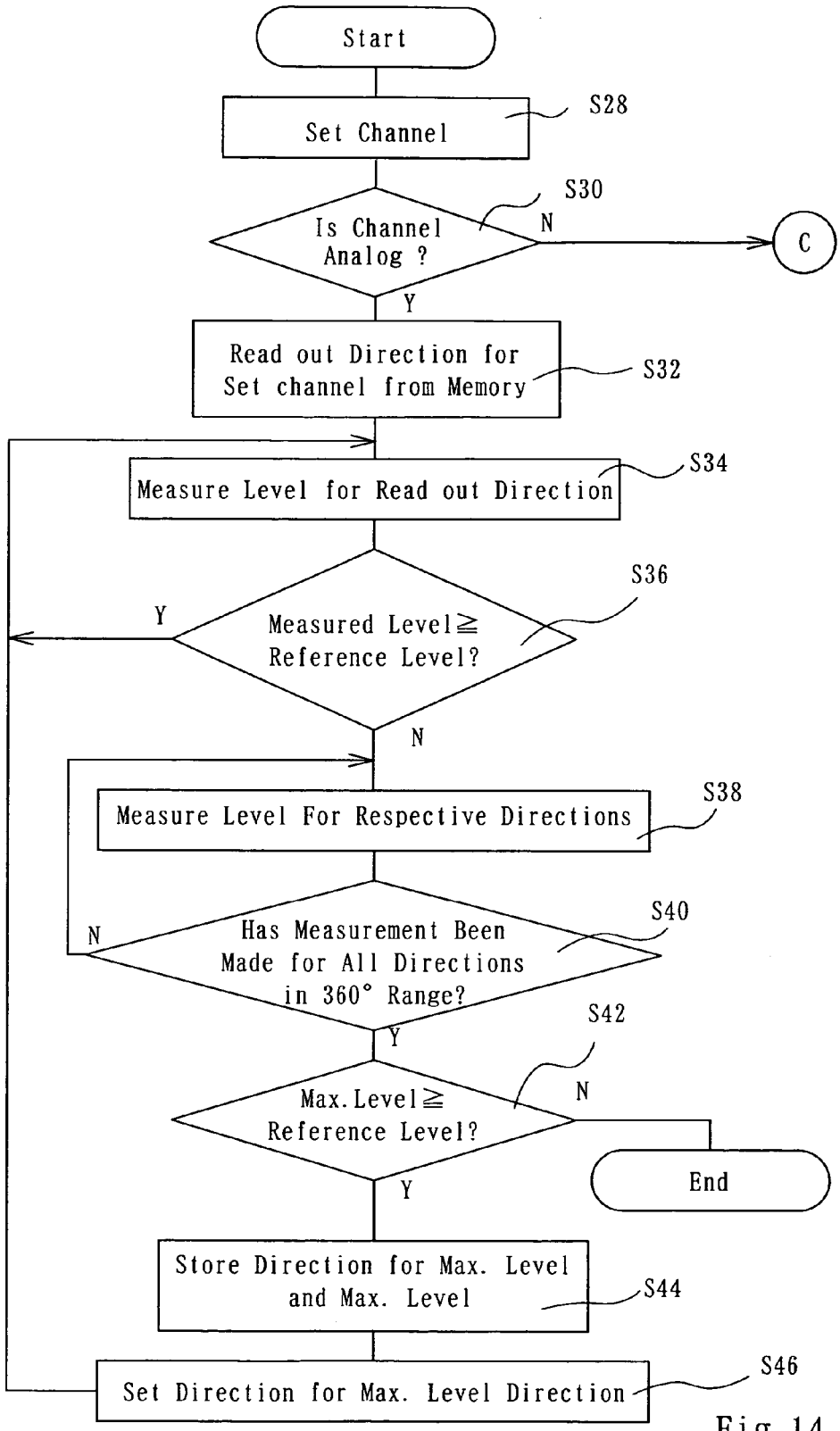
FIG. 14 shows part of a flow chart for use in explaining the processing performed in the tuner of the receiving apparatus of FIG. 11A when the antenna directivity deviates from an acceptable state.
Figure 15:
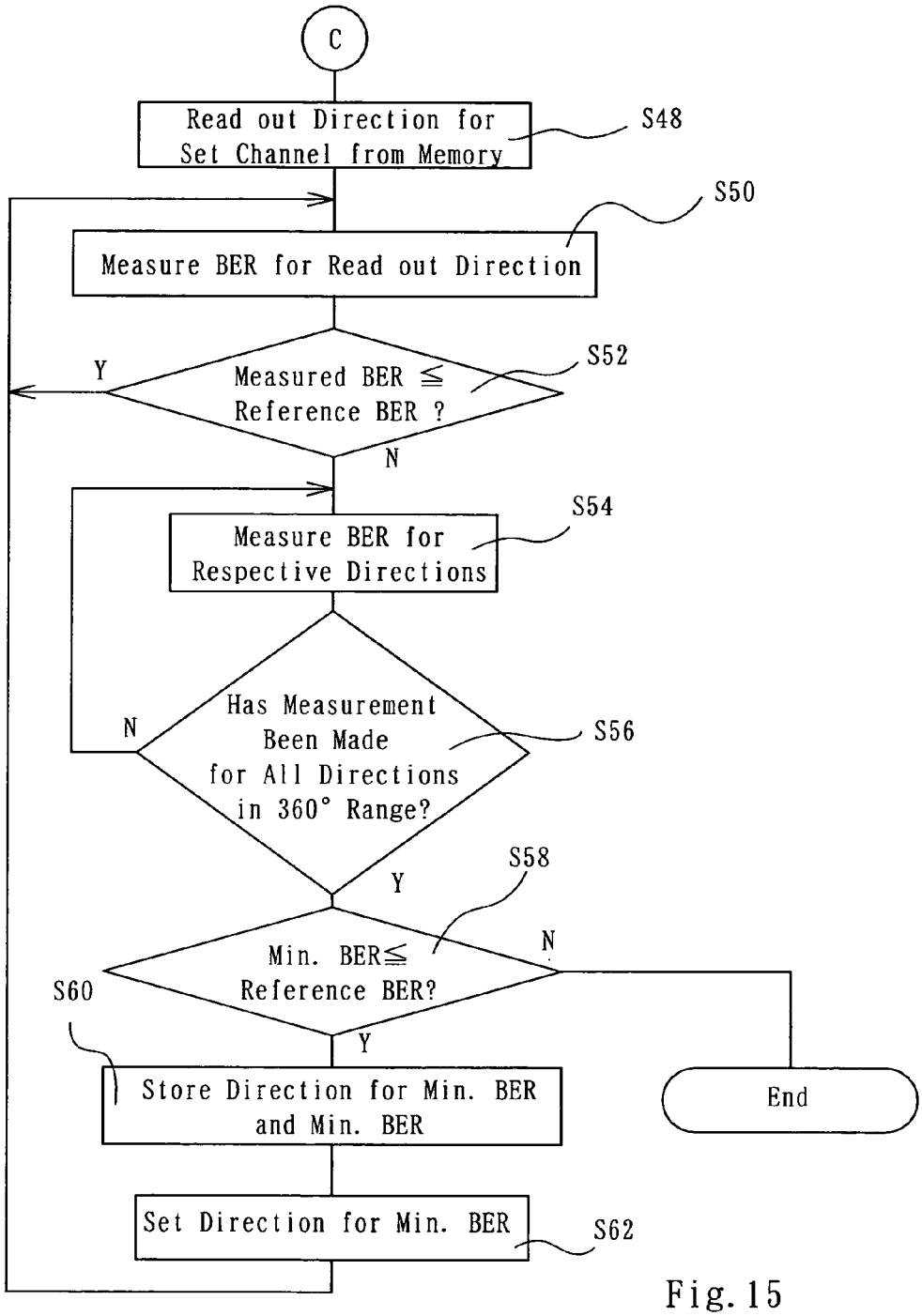
FIG. 15 shows the remainder of the flow chart for use in explaining the processing performed in the tuner of the receiving apparatus of FIG. 11A when the antenna directivity deviates from an acceptable state.

Referring to FIG. 14, a desired channel to be received is selected and set (Step S28). Whether the desired channel is an analog television broadcast channel or a digital television broadcast channel is judged (Step S30). If the selected channel is an analog channel, the antenna control data relating to the direction of directivity for the desired channel is read out from the memory 131 and set (Step S32). Then, the reception signal level for the set directivity is measured (Step S34). The measured level is examined as to if it is equal to or higher than the reference level (Step S36). If the level is at or above the reference level, which means that the signal is being received in a good condition, the reception of the radio wave of the channel is continued, repeating Steps S34 and 36 in loop.

If it is judged, in Step S36, that the received signal level is lower than the reference level, the direction of antenna directivity is successively altered, and the signal level at each of the altered directions is measured and stored (Step S38). Then, whether the signal levels for all the predetermined directions in the 360° angular range have been measured and stored is judged (Step S40), and, if not, Steps S38 and S40 are repeated in loop until the answer to Step S40 becomes YES. When it is judged, in Step S40, that the signal levels at all of the predetermined directions have been measured and stored, the highest one of the measured signal levels is examined as to if it is equal to or above the reference level (Step S42). If the answer is YES, the direction in which the highest level is obtained and the reception level are stored in the memory 131 (Step S44).

Then, the antenna directivity is set for that direction (Step S46), and the processing resumes from Step S34.

The answer of NO to the query in Step S42 may mean that the signal in the channel cannot be received in an allowable condition with any directivities or the signal has disappeared. Accordingly, the reception of the signal in that channel is abandoned.

If the desired signal to be received is judged to be a digital television broadcast channel signal in Step S30, the processing shown in FIG. 15 is executed, as indicated by a circled C in FIG. 14. The antenna system is set for the antenna directivity for the channel set in Step S28, using the data read out from the memory 131 (Step S48). Then, the BER (bit error rate) for that directivity is measured (Step S50). Whether the measured BER is not greater than the reference value is examined (Step S52). The fact that the measured BER is equal to smaller than the reference value means that the signal of the set digital broadcast channel is being received at an allowable level, the reception is continued, and the execution of Steps S50 and S52 is iterated. If the answer to the query in Step S52 becomes NO, the antenna directivity is successively changed stepwise over a 360° angular range, and the BER for each directivity is stored (Step S54). Whether the antenna directivity has rotated 360° or not is judged (Step S56), and, if the answer is NO, the execution of Steps S54 and S56 is iterated until the answer changes to YES. When the answer to the query in Step S56 changes to YES, whether the smallest one of the stored values of BER is not greater than the reference BER value is examined (Step S58). If the answer is YES, the direction or directivity for which that smallest BER is obtained is stored together with that BER in the memory 131 (Step S60). The antenna directivity is adjusted to the stored direction (Step S62), and the processing is repeated from Step S50 again.

The answer of NO to the query in Step S58 may mean that the signal in the channel cannot be received in an allowable condition with any directivities or the signal has disappeared. Accordingly, the reception of the signal in that channel is abandoned.

Figure 16:
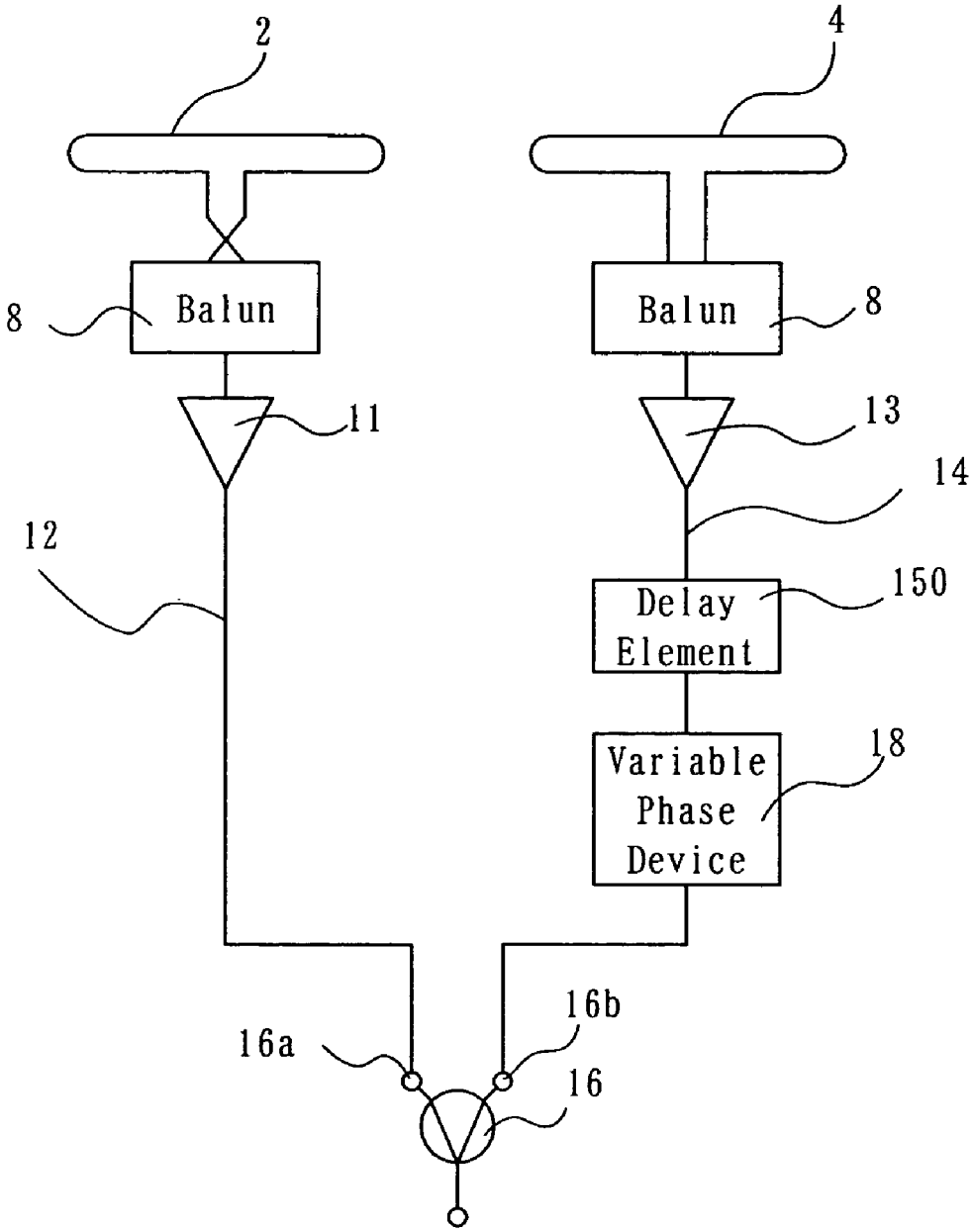
FIG. 16 is a block diagram of a modification of the antenna shown in FIG. 1.

The antenna 1 shown in FIG. 1 is arranged such that the received signals from the antenna elements 2 and 4 are coupled in phase with each other to the baluns 8 and 10, that the length of the feeder 12 is longer by ΔL than the feeder 14 to provide a delay, and that the variable phase device 18 is used. Alternatively, as shown in FIG. 16, the received signal from the antenna element 2 may be coupled to the balun 8 with a phase opposite to the phase of the received signal coupled from the antenna element 4 to the balun 10, with the feeder 14 longer by ΔL than the feeder 12 used to provide a delay as represented by a delay element 150, and with the variable phase device 18 connected in the succeeding stage of the delay element 150. The same modification may be done to the variable directivity antenna according to the second embodiment shown in FIG. 6.

Figure 17:
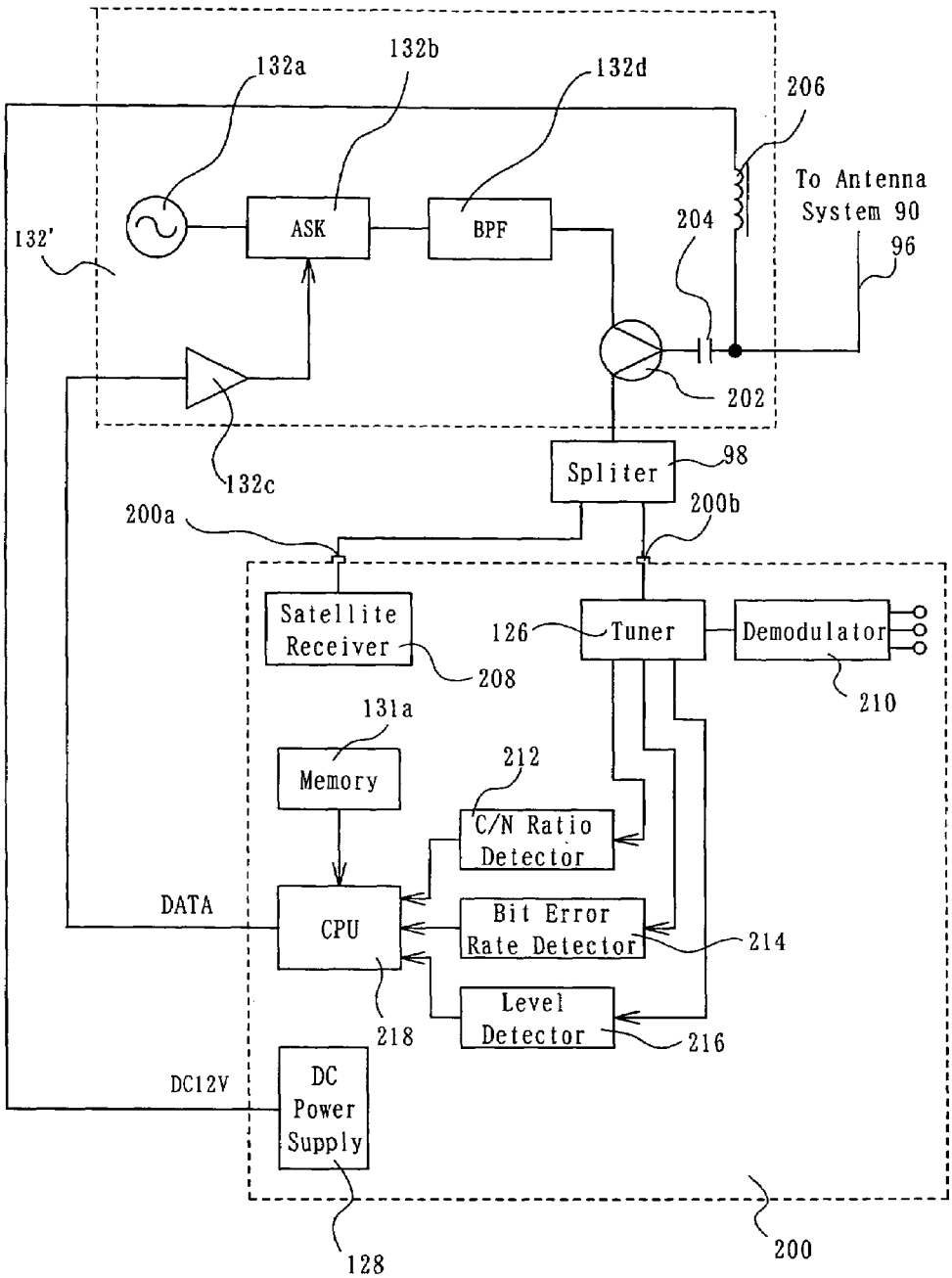
FIG. 17 is a block diagram of a modification of the signal receiving system shown in FIG. 7.

The signal receiving system according to the third embodiment has the antenna control commander 132 within the receiving apparatus 100, but an antenna control commander 132' shown in FIG. 17 is disposed external to a receiving apparatus 200. Like the receiving apparatus 100, the receiving apparatus 200 also includes the tuner 126 and the DC power supply unit 128. The antenna control commander 132' external to the receiving apparatus 200 is supplied with the antenna control data from the receiving apparatus 200. The configuration of the antenna control commander 132' shown FIG. 17 is similar to that of the antenna control commander 132 shown in FIG. 11B, except that it includes also a mixer 202, a DC blocking capacitor 204 and a high-frequency blocking coil 206. The ASK signal from the antenna control commander 132' is outputted from DC blocking capacitor 204 and applied to the antenna system 90 through the transmission line 96. A DC voltage, e.g. a DC voltage of 12 V, from the DC power supply unit 128 within the receiving apparatus 200 is also applied to the transmission line 96 through the high-frequency blocking coil 206, for application to the antenna system 90. The television signals (i.e. a UHF or VHF band television broadcast signal and a satellite broadcast intermediate-frequency signal) from the antenna system 90 are applied, through the transmission line 96, the DC blocking capacitor 204 and the mixer 202, to the splitter 98, where they are split into the UHF or VHF band television broadcast signal and the satellite broadcast intermediate-frequency signal. The satellite broadcast intermediate-frequency signal is applied to the satellite broadcast intermediate-frequency signal input terminal 200*a* of the receiving apparatus 200, and the VHF or UHF band television broadcast signal is applied to the UHF/VHF band television broadcast signal input terminal 200*b* of the receiving apparatus 200.

The satellite broadcast intermediate-frequency signal coupled to the satellite broadcast intermediate-frequency signal input terminal 200*a* is applied to a satellite receiver 208, where it is demodulated. The demodulated signal is then applied to a television receiver (not shown). The VHF or UHF band television broadcast signal coupled to the UHF/VHF band television broadcast signal input terminal 200*b* is converted to an intermediate-frequency signal in the tuner 126 and, then, applied to a demodulation unit 210, where it is demodulated. Regardless whether the VHF or UHF band television broadcast signal is an analog broadcast signal or a digital broadcast signal, it is demodulated in the demodulation unit 210, and the demodulated signal is applied to the television receiver.

The intermediate-frequency signal from the tuner 126 is also applied to a receiving condition detecting unit which may include, for example, a C/N ratio detector 212, a bit error rate detector 214 and a level detector 216. The C/N ratio detector 212 detects the C/N ratio of the VHF or UHF band television broadcast signal, and provides the result of detection to receiving apparatus control means, such as a CPU 218. The bit error rate detector 214 detects the bit error rate of a digital broadcast signal when the VHF or UHF band television broadcast signal is a digital signal, and provides the result of detection to the CPU 218. The level detector 216 detects the level of the VHF or UHF band television broadcast signal, and provides the result of detection to the CPU 218.

The CPU 218 has a memory 131*a* similar to the memory 131 used in the system according to the third embodiment. When a command to receive a television broadcast signal in a selected one of VHF or UHF channels is externally applied to the CPU 218, the antenna control data for the selected channel is read out of the memory 131*a* and is supplied to the antenna control commander 132. In response to it, the directivity of the antenna system 90 is oriented to the direction from which the wave of the selected channel comes. Then, the C/N ratio detector 212, the bit error rate detector 214 and the level detector 216 detect the C/N ratio, the bit error rate and the signal level, and the detection results are supplied to the CPU 218.

When the signal being currently received is a digital broadcast channel signal, and selected one of the C/N ratio, the bit error rate and the level of the digital signal, e.g. the C/N ratio, is smaller than a predetermined reference value, or, in other words, when the signal receiving condition is unacceptable, the CPU 218 causes the directivity of the antenna system 90 to be changes in the manner as described with respect to the third embodiment to determine the direction in which the C/N ratio is above the predetermined reference value. At the same time, the antenna control data for receiving the signal in that channel is renewed to the antenna control data to orient the antenna system 90 to that direction, and the renewed antenna control data is stored in the memory 131*a*. After that, the antenna control data used to receive a signal in that channel is the renewed antenna control data. When the bit error rate is selected, similar antenna control data renewal is carried out if the detected bit error rate is above a predetermined value, and, when the level is selected, similar antenna control data renewal is carried out if the detected level is below a predetermined level.

If the signal being currently received is an analog broadcast channel signal, either one of the C/N ratio or the signal level is detected, and if the detected value is smaller than a predetermined C/N ratio or signal level, the directivity of the antenna system 90 is changed in a manner similar to the one described above, and the antenna control data is renewed in a manner similar to the described one.

The antenna system 90 according to the third embodiment uses two antennas 30*a* and 30*b*, but the number is not limited to two, and a larger number of antennas may be used. Furthermore, instead of using dipole antennas as the antennas 30*a* and 30*b*, folded dipole antennas as used in the antenna 1 shown in FIG. 1 may be employed.

What is claimed is:

1. A signal receiving system comprising:

a variable directivity antenna having its directivity varied in accordance with a control signal applied thereto;

a control signal generator for generating said control signal;

a modulator for modulating a carrier with said control signal from said control signal generator to develop a modulated signal; and a controller for demodulating said modulated signal to recover said control signal from said modulated signal and applying said recovered control signal to said variable directivity antenna to thereby vary the directivity of said variable directivity antenna.

2. The signal receiving system according to claim 1 wherein said modulator ASK modulates said carrier with said control signal.

3. The signal receiving system according to claim 1 wherein said variable directivity antenna is coupled to a receiving apparatus through a transmission line, and said receiving apparatus through a transmission line, and said receiving apparatus includes therein said modulator and said control signal generator, said transmission line transmitting a signal received by said variable directivity antenna to said receiving apparatus and transmitting said modulated signal from said receiving apparatus to said variable directivity antenna.

4. The signal receiving system according to claim 1 wherein said variable directivity antenna is coupled to a receiving apparatus through a transmission line, and said modulator is external to said receiving apparatus, said transmission line transmitting a signal received by said variable directivity antenna to said receiving apparatus and transmitting said modulated signal from said modulator to said variable directivity antenna.

5. The signal receiving system according to claim 1 wherein said variable directivity antenna is adapted to receive a signal received by a separate antenna, and is provided with combining means for combining said signal received by said separate antenna with a signal received by said variable directivity antenna, an output signal of said combining means being coupled to a receiving apparatus through a transmission line.

6. The signal receiving system according to claim 1 wherein said variable directivity antenna comprises: two directional antennas disposed in such a manner that their directivities can be orthogonal to each other, and two level adjusting means to which signals received by respective ones of said two directional antennas are applied, respectively; said level adjusting means being controlled with said control signal.

7. The signal receiving system according to claim 1 wherein:

said variable directivity antenna is coupled to a receiving apparatus through a transmission line; and said receiving apparatus comprises:

signal receiving condition detecting means for detecting a condition in which a desired signal is being received; and receiving apparatus control means for, when the signal receiving condition becomes unacceptable, changing said control signal to be supplied to said modulator from said control signal generator, and providing, to said modulator, the current control signal being supplied when the signal receiving condition as detected by said signal receiving condition detecting means becomes acceptable.

* * * * *